United States Patent [19]

Musgrave

[11] 4,045,985

[45] Sept. 6, 1977

[54] APPARATUS FOR MAKING BARBED MATERIAL

[76] Inventor: Daniel Dennis Musgrave, 8201 Caraway St., Cabin John, Md. 20731

[21] Appl. No.: 770,357

[22] Filed: Feb. 22, 1977

[51] Int. Cl.[2] ..... B21F 25/00; B21D 26/14

[52] U.S. Cl. ..... 72/56; 72/DIG. 30; 140/58

[58] Field of Search ..... 72/56, DIG. 30; 140/58, 140/66; 29/7.1

[56] References Cited

U.S. PATENT DOCUMENTS

| | | | |
|---|---|---|---|
| 3,212,311 | 10/1965 | Inoue | 72/DIG. 30 |
| 3,941,164 | 3/1976 | Musgrave | 140/58 |

*Primary Examiner*—Lowell A. Larson

[57] ABSTRACT

Apparatus for making barbed material by tractive magnetic means. A work piece of ferrous or other magnetic material is prepared with slits intersecting its edges. The work piece is passed through a guide channel in the apparatus. Along the divergent sides of the channel are contact pieces magnetized by electromagnets. The contact pieces attract the edges of the strip and deform pointed portions out from the strip. The apparatus includes mechanism for moving the strip in a predetermined manner. This abstract is prepared to facilitate searching and it is not to be construed as a limitation of the invention.

10 Claims, 2 Drawing Figures

APPARATUS FOR MAKING BARBED MATERIAL

U.S. Pat. No. 3,941,164 issued Mar. 2, 1976 discloses a process for making barbed material. The present invention concerns an apparatus for use in a process such as that described in the said patent.

Although various forms of barbed wire has been in use for more than a hundred years, it has certain disadvantages. It is awkward to handle because it is usually supplied in coils with many barbs exposed. This is particularly objectionable for military use where obstacles must sometimes be installed under adverse conditions of weather and terrain.

Flat tapes with barbs along their edges have the distinct advantage that they can be coiled on a reel. In this compact form they occupy relatively little space and the sides of the reel can cover the barbs thus protecting the person handling the material. Such tapes can also be incorporated into various self-supporting obstacles such as the well-known concertina.

A significant factor in the cost of barbed tape is the scrap loss. When barbs are formed on the tape by blanking or similar operations, scrap generation is inevitable. This can be avoided by so designing the tape that the barbs comprise pointed portions bent away from the tape proper. A process for making barbed material in this manner is described in the cited U.S. Pat. No. 3,941,164.

The principal object of this invention is to provide an apparatus for making barbed material by tractive magnetic means. The material to be barbed might be tape or strip or in other forms.

This and other objects of the present invention will become apparent upon consideration of the following detailed description taken in conjunction with the accompanying drawings, wherein.

Figure 1:
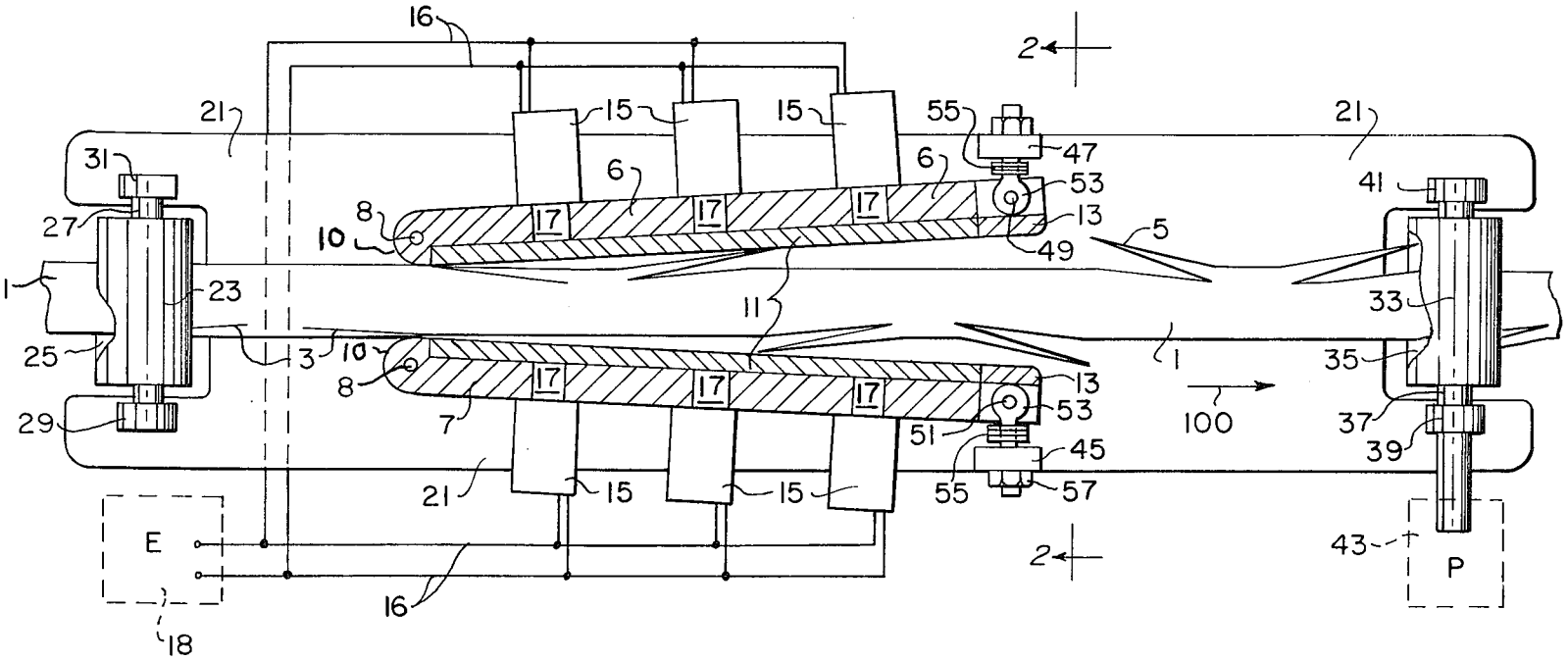
FIG. 1 is a plan view, from above, and partly sectioned, of an apparatus for making barbed material.

Referring to the drawings in detail the apparatus comprises a base 21 on which is mounted a pair of guides 6 and 7. One end of each guide is adapted for swiveling around a pivot 8 which is supported on base 21. The other end of each guide is attached to an adjustable support so that the included angle between the guides can be fixed within certain limits. Brackets 45 and 47 are affixed to base 21. An eyebolt 53 passes through a suitable hole in each bracket and is secured by nut 57.

The eye of each eyebolt engages with a stud 49 fixed on guide 6, or 51 fixed on guide 7. One or more spacers 55 are placed on each eyebolt between the bracket and the guide to adjust the angle between the guides. The nut is then tightened to secure each guide in position.

The end of each guide near pivot 8 is rounded as indicated at 10. This shape provides a smooth contact for material which is being passed between the guides. The material might be a strip such as 1 in FIG. 1, which is assumed to be moving from left to right of the viewer, as indicated by arrow 100.

Affixed to each guide in any convenient manner is one or more electromagnets 15 having conductors 16 leading to a source of electric power indicated by symbol E at 18. The source would include a switch or other control, not shown.

Each electromagnet has a pole 17 in contact with a magnetic contact means 11 which is affixed to one of the guides in any convenient manner. As will be understood hereinafter, the contact means will be subject to wear when in use, so it can be made reversible to permit use of either side against the guide.

Also affixed to the base are bearings 29, 31, 39 and 41 which support shafts 27 and 37.

Roller 23 is supported on shaft 27, while roller 25 is supported on a similar shaft (not shown). This pair of rollers is idle, and positioned so as to permit strip 1 to pass therebetween. Frictional or other means may be provided to retard turning of the idle rollers.

Roller 33 is supported on, and may be driven by, shaft 37. Shaft 37 is mechanically connected to a prime mover P, indicated at 43. Roller 35, which may be idle or driven, cooperates with roller 33. The shaft on which roller 35 is supported is not visible in the drawings.

Figure 2:
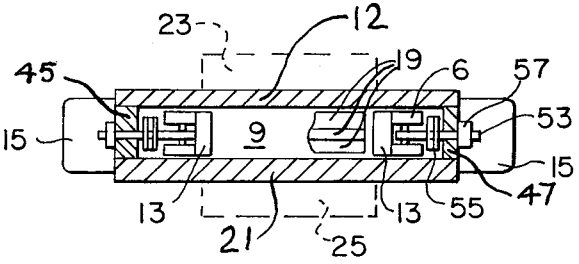
FIG. 2 is a cross-section taken in the plane indicated by numerals 2—2 on FIG. 1.

The channel formed by guides 6 and 7 can be provided with a suitable top 12 which can be supported by brackets 45 and 47, and by pivots 8 in the well known manner. The base, guides and top form a channel 9 as indicated in FIG. 2.

In operation, a strip 1 is prepared with slits such as 3 intersecting one or more of its edges. The slits shown are only exemplary as the apparatus disclosed can be used with material having various geometric configurations along its edge.

The strip in entered between rollers 23 and 25, and then between guides 6 and 7, and finally between rollers 33 and 35. The electromagnets are energized from source 18, with suitable polarity, and roller 33 is turned in the proper direction by the prime mover. Rollers 33 and 35 exert a tractive force on the strip and move it in the direction indicated by arrow 100. The strip may be kept properly centered between the guides by tensioning it between the two pairs of rollers.

As the strip moves past contact means 11, the magnetic attraction of the divergent contact means bends points 5 out to become barbs. As may be seen in FIG. 2, a plurality of strips 19 may be superimposed and passed through the apparatus simultaneously.

It is preferable that guides 6 and 7 be not easily magnetized, and that a member such as 13, not easily magnetized, guide each barb as it leaves contact means 11 to prevent distortion.

There is thus disclosed an apparatus for making barbed material employing magnetic traction. It is desired to emphasize that the disclosed embodiment is exemplary, and that changes in arrangement or construction can be made within the scope of the invention.

What I claim is:

1. Apparatus for making barbed material comprising: a base; mechanism on said base adapted for moving a piece of magnetic material in a predetermined direction substantially along a predetermined center line; and means on said base for exerting a tractive magnetic force on an edge of said piece in a direction substantially perpendicular to said centerline whereby a deformable portion of said edge can be bent out from said piece.

2. Apparatus for making barbed tape comprising: a base; guide means on said base and positionally adapted to permit the passage of a strip of magnetic material in a predetermined direction substantially along a predetermined center line; magnetic contact means along at least one side of said guide means, said contact means being in polar contact with an electromagnet, and said contact means having a predetermined inclination relative to said center line; means for energizing said electromagnet; and mechanism on said base positionally adapted for moving said piece past said guide means in said predetermined direction with an edge of said piece substantially parallel to said centerline whereby a deformable portion of said edge can be bent out from said piece.

3. Apparatus as set forth in claim 2 wherein said guide means are plural and divergent, and wherein the angle between said plural guide means can be adjusted.

4. Apparatus as set forth in claim 3 wherein one end of each of said guide means is faired to facilitate the entry of said strip between said guide means.

5. Apparatus as set forth in claim 2 wherein said contact means comprises material having a low coefficient of friction.

6. Apparatus as set forth in claim 2 wherein said contact means are plural and are positionally adapted for contacting opposite edges of said strip.

7. Apparatus as set forth in claim 2 wherein said strip is plural and the strips are superimposed.

8. Apparatus as set forth in claim 3 wherein said angle can be adjusted by moving at least one said guide.

9. Apparatus as set forth in claim 2 wherein said contact means can be affixed to said guide means in several alternate orientations.

10. Apparatus as set forth in claim 2 wherein the length of said guide means is substantially greater than the length of said contact means.

* * * * *